United States Patent [19]

Chiaramonte, Jr.

[11] 4,020,572

[45] May 3, 1977

[54] ILLUMINATED FOOTWEAR

[76] Inventor: Gasper Chiaramonte, Jr., 229 Court Ave., Lyndhurst, N.J. 07071

[22] Filed: Feb. 17, 1976

[21] Appl. No.: 658,383

[52] U.S. Cl. ..... 36/137

[51] Int. Cl.[2] ..... A43B 23/00

[58] Field of Search ..... 36/137

[56] References Cited

UNITED STATES PATENTS 1,597,823 8/1926 Randolph ..... 36/137

3,893,247 7/1975 Dana ..... 36/137

FOREIGN PATENTS OR APPLICATIONS 498,808 9/1954 Italy ..... 36/137

*Primary Examiner*—Patrick D. Lawson

[57] ABSTRACT

A wedge-shaped platform for footwear and having an illuminated sole portion that is self-contained with a power source therefor, automatically operable and/or manually controlled for high intensity light emission therefrom.

5 Claims, 4 Drawing Figures

ILLUMINATED FOOTWEAR

BACKGROUND

Footwear is characteristically in the form of a boot, shoe or sandal comprising an upper portion that is secured over a persons foot and a lower portion that is the under part upon which the person walks. The latter lower portion is the sole or platform of the shoe with which the present invention is concerned, the upper portion taking form as circumstances require. Since it is a primary object of this invention to illuminate the shoe, a platform type sole is employed and formed so as to provide the interior space as necessary for accommodating illumination means as will be described.

Platform shoes have developed in various forms and one of which is the "wedge" wherein the sole, instep and heel are integral and in appearance present a solid. The wedge is of course styled and/or sculptured to have the desired appearance, generally tapered from top to bottom, the top surface being contoured to comfortably fit the sole of a persons foot and the bottom surface being flat for ground engagement. Also, in plan view the width is contoured to have conformity with the shape of the persons foot, the front sole section being wider as a rule than the rear heel section. Heretofore, such wedges have been made from solid light weight materials, and they have been molded with hollowed interiors for savings in weight and material. It is this latter type of construction which is advantageously employed by this invention, as will be described.

SUMMARY OF THE INVENTION

This invention relates to footwear or shoes per se that are illuminated for entertainment purposes and the like. Shoes of the type under consideration have been employed to raise or elevate the stature of persons wearing the same, and although shoes are made to be decorative and stylish the soles thereof have not been accentuated to their fullest extent. With the view of gaining attention and for the purpose of creating excitement, as in the course of entertaining and for the sake of novelty and attention to be gained thereby, it is an object of this invention to illuminate the sole or wedge of shoes.

As pointed out above, wedge soles are most often light weight solids but can be of shell construction, and it is an object herein to advantageously employ the shell-type wedge with a portion thereof made of material adapted to emit light. Further, it is an object of this invention to provide a light source within the wedge, and still further an object to provide an energy source for the light within the wedge.

The dispersion and intensity control of light is also an object of the present invention, and to this end the light source is directed by lens means and intensity increased by energy storage. With this invention the energy means is discharged to the light source automatically or by switch means controlled by the person wearing the shoes.

In view of the foregoing, it is an object therefore to provide a wedge constructed shoe with self-contained illumination and yet serviceable as footwear without restriction. To these ends, the wedge is essentially a two piece article comprised of a platform and an instep, the platform being adapted to contain the illuminating means and power supply therefor and formed of a material conducive to the emission of light, and the instep adapted to close the wedge for said containment of elements and to normally support the person and secure to the foot by means of the upper portion of the shoe adapted thereto.

DRAWINGS

The various objects and features of this invention will be fully understood from the following detailed description of the typical preferred forms and applications thereof, throughout which description reference is made to the accompanying drawings, in which.

PREFERRED EMBODIMENT

Figure 1:
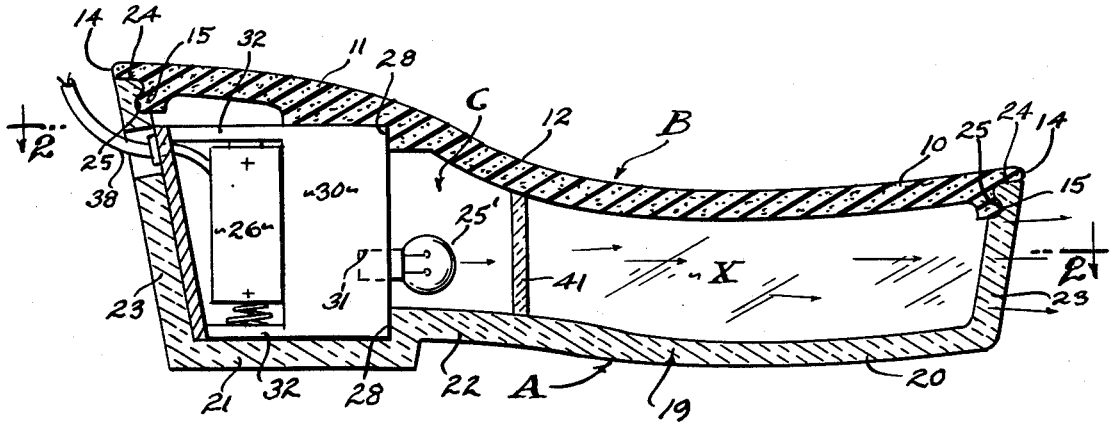
FIG. 1 is a longitudinal cross section through a typical embodiment of the illuminated shoe platform of the present invention.
Figure 2:
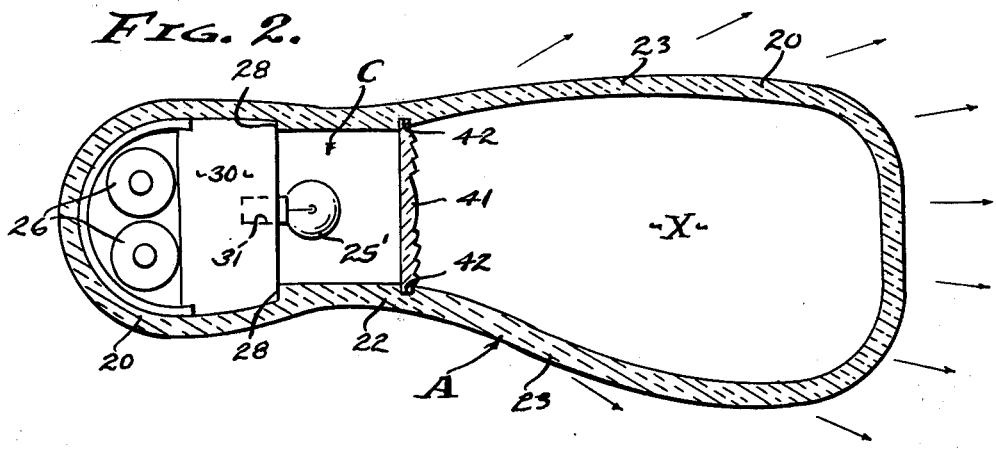
FIG. 2 is a plan section taken as indicated by line 2—2 on FIG. 1.

Referring now to the drawings, a typical wedge configured shoe platform is shown in FIG. 1 and comprised of a platform or sole A of shell-form and an instep B detachable from the sole to retain illumination means C in working position therein. As shown, the sole A and instep B secured thereto present a raised platform for the foot supporting instep B that is coextensive with the plan configuration of the sole A and having a front toe section 10, a rear heel section 11 and an intermediate arch section 12. In accordance with normal shoe design, the heel is the deepest section that fairs into the toe via the arch, the instep B being in the form of one structural member adapted to sustain the standing weight applied by the foot of the wearer. Accordingly, the instep is made of a usual opaque substance formed to a suitable configuration such as that shown, and in this instance with a peripheral bead or channel member 15 depending from and inward of its perimeter edge 14. The instep is preferably a flexible member, held in position by the bead 15, and it can be formed of a depressible material such as to have a cushioned effect if so desired.

The sole A of the shell-form characterizes this invention and is comprised of heel and toe sections 20 and 21 joined by the intermediate arch section 22. The shell of sole A involves a ground engaging base 19 coextensive with the sections 20, 21 and 22 and with an exterior wall 23 extending upwardly from the base 19 to a perimeter edge 24 configuration coincidental with the perimeter edge 14 of the instep B. As shown, the upper marginal portion of the wall 23 is provided with a bead or channel member 25 that mates with the complementary member 15 of the instep to releasably secure one to the other. Accordingly, the sole A is made of a rigid material formed to the shell configuration shown, having wall thickness as shown so as to present the chambered interior X. And, in accordance with this invention the exterior wall 23 is at least translucent and preferably transparent for the transmission of light therethrough as emitted by the means C next to the described. It will be apparent that the chamber interior X is sizeable and characterized by a deep accommodating section underlying the heel.

The illuminating means C can vary in form from a incandescent light source to any one of the high intensity forms such as a gas-discharge type shown. A feature of the invention is the containment of the illuminating means C within the confines of the shoe platform, including the lamp 25, battery 26, and light emission control means 27. The lamp-battery-control means is shown as an assembly that is inserted into the heel well of the shoe platform, positioned by rearwardly disposed shoulders 28 at the arch section and retained by snap-on installation of the sole B into position as shown. Accordingly, the illuminating means C comprises a case 30 that has a receptacle 31 to mount the lamp 25, clamps 32 or the like to contact the battery 26, and a controllable circuit means 27—27' such as is diagrammed in FIGS. 3 and 4. The unit or assembly of illuminating means C is secured and rattle-proofed when captured in working position as shown.

Figure 3:
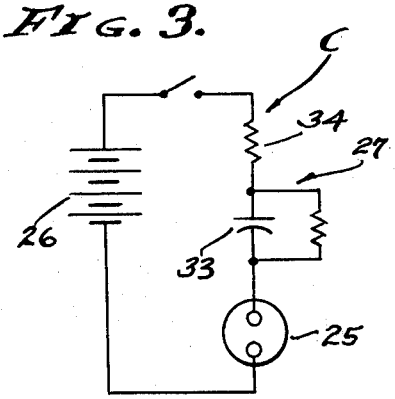
FIGS. 3 and 4 are electrical diagrams of illuminating means, FIG. 3 being automated and FIG. 4 to be controlled by the wearer.

Referring to the electrical diagram of FIG. 3, a basic timed discharge circuit is shown, wherein the battery 26 charges a capacitor 33 as controlled by a resistor 34, the timed discharge being through the gas filled lamp 25 to emit light.

Figure 4:
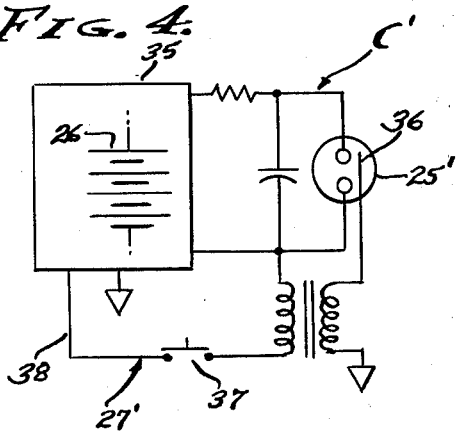

Referring to the electrical diagram of FIG. 4, a basic controllable discharge circuit is shown, wherein the battery 26 charges a power pack 35 that increases the voltage for high intensity light emission from lamp 25'; in this form controlled by a trigger element 36 in a transformer circuit closed to battery 26 by a remote switch 37 to be hand operated by the wearer at the end of an extension cable 38 conveniently locatable for actuation.

The illumination means C is housed within an opaque case 30 adapted to shield the lamp 25; and between the sole section and arch section there is an interchangeable lens 41 removably carried in opposed slots 42 formed in the opposite walls 23 of sole A, for the direction of and color control of light emission. That is, the spread or concentration and color of light emission is governed by lens 41, preferably a Fresnel lens incorporated in a panel of transparent material colored or tinted as circumstances require. Accordingly, the light intermittently emitted by lamp 25 (25') through the lens 41 is transmitted to and/or through the translucent and preferably transparent wall underlying and surrounding the sole-toe portion of the shoe platform.

Having described only typical preferred forms and applications of my invention, I do not wish to be limited or restricted to the specific details herein set forth, but wish to reserve to myself any modifications or variations that may appear to those skilled in the art:

I claim:

1. A shoe platform comprised of a sole having an upstanding perimeter wall carrying a foot supporting instep coextensively overlying the sole and establishing a chamber therein, the perimeter wall being made of light transmitting material, and illumination means comprising a lamp within an arch section of the chamber and faced forwardly emitting light for illuminating through the perimeter wall of the shoe platform.

2. The illuminated shoe platform as set forth in claim 1, wherein the illuminating means includes a forwardly faced lens directing light emitted from said light source for illumination through the perimeter wall forward thereof.

3. The illuminated shoe platform as set forth in claim 1, wherein the illuminating means includes the encasement of a light source and battery therefor in a unit replaceable in a heel section of the chamber, there being a lens ahead of said light source for directing illumination through the perimeter wall forwardly thereof.

4. The illuminated shoe platform as set forth in claim 1, wherein the illuminating means includes a capacitor discharge circuit intermittently emitting light therefrom.

5. The illuminated shoe platform as set forth in claim 1, wherein the illuminating means includes a power-pack with trigger means extended by a cable controlled by a switch remote from the shoe to emit light therefrom.

* * * * *